US008038312B2

(12) United States Patent
Otsuki et al.

(10) Patent No.: US 8,038,312 B2
(45) Date of Patent: Oct. 18, 2011

(54) SHOWCASE

(75) Inventors: Atsuo Otsuki, Gunma-ken (JP); Yoichi Amari, Ota (JP); Tetsuya Oketani, Ota (JP)

(73) Assignee: Sanyo Electric Co., Ltd., Moriguchi-Shi (JP)

( * ) Notice: Subject to any disclaimer, the term of this patent is extended or adjusted under 35 U.S.C. 154(b) by 147 days.

(21) Appl. No.: 12/260,587

(22) Filed: Oct. 29, 2008

(65) Prior Publication Data

US 2009/0116228 A1 May 7, 2009

(30) Foreign Application Priority Data

Nov. 1, 2007 (JP) ..... 2007-285561

(51) Int. Cl.
*A47F 11/10* (2006.01)

(52) U.S. Cl. ..... 362/125; 362/249.02

(58) Field of Classification Search ..... 362/249.02–249.03, 125–126, 362/92, 94
See application file for complete search history.

(56) References Cited

U.S. PATENT DOCUMENTS

| | | | | |
|---|---|---|---|---|
| 6,942,356 | B1 * | 9/2005 | Hahn | 362/125 |
| 7,207,696 | B1 * | 4/2007 | Lin | 362/249.03 |
| 7,648,251 | B2 * | 1/2010 | Whitehouse et al. | 362/223 |
| 2006/0198144 | A1 | 9/2006 | Miyairi et al. | 362/257 |
| 2007/0171647 | A1 | 7/2007 | Artwohl et al. | 362/276 |
| 2007/0195535 | A1 | 8/2007 | Artwohl et al. | 362/341 |
| 2008/0094824 | A1 * | 4/2008 | Stack et al. | 362/125 |
| 2011/0058357 | A1 * | 3/2011 | Anderson | 362/125 |

FOREIGN PATENT DOCUMENTS

| | | |
|---|---|---|
| JP | 8-224150 | 9/1996 |
| JP | 2546302 | 5/1997 |
| WO | WO 01/00065 | 1/2001 |
| WO | WO 2006/086998 | 8/2006 |
| WO | WO 2007/043034 | 4/2007 |

OTHER PUBLICATIONS

European Search Report dated Feb. 12, 2009.

* cited by examiner

*Primary Examiner* — Robert May
(74) *Attorney, Agent, or Firm* — Kratz, Quintos & Hanson, LLP

(57) ABSTRACT

An object is to provide a showcase capable of effectively illuminating commodities displayed on a shelf in a display chamber, especially commodities in shelf foremost parts. In the showcase in which the shelf for displaying the commodities is disposed in the display chamber constituted in a main body and in which a front-surface opening of the display chamber is openably closed by see-through doors and in which an illumination device is vertically attached to the main body on an inner side from the edge of the opening, the illumination device is constituted of LED elements, and light from the LED elements is emitted toward front parts of the shelf.

2 Claims, 9 Drawing Sheets

SHOWCASE

BACKGROUND OF THE INVENTION

The present invention relates to a showcase in which a shelf for displaying commodities is disposed in a display chamber constituted in a main body, a front-surface opening of the display chamber is openably closed by a see-through door, and illumination devices are vertically attached to the main body on an inner side from the edge of an opening.

Heretofore, in this type of showcase, a pillar is disposed in a vertical direction in the center of a front-surface opening edge or on each side of the opening edge, and a fluorescent lamp is attached to the rear surface of this pillar to illuminate the inside of the display chamber from the front side (e.g., see Japanese Patent Application Laid-Open No. 8-224150 (Patent Document 1) and Japanese. Utility Model Registration No. 2546302 (Patent Document 2)).

Here, conventional illumination by the fluorescent lamp will be described with reference to FIGS. 10 and 11. FIG. 10 shows a front view showing an illumination state of a part of a reach-in showcase 100, and FIG. 11 shows a partially enlarged sectional view showing the illumination state of FIG. 10, respectively.

A main body 101 constituting the showcase 100 has such a substantially U-shaped section that the front surface of the main body is open, and the main body is constituted of an outer box 102, an inner box constituting a display chamber 104 therein, and an insulating material with which a space between both the boxes is filled. In the display chamber 104, a plurality of stages of shelves 107 . . . are disposed in a vertical direction. Moreover, in the front surface of the inner box, a plurality of pillars 106 are vertically disposed on both left and right sides of the front surface and in portions with a predetermined space between the portions and the sides, and each of doors 105 . . . which openably close the front-surface opening of the display chamber 104 is provided between the pillars 106. One side end of this door 105 is rotatably supported by the pillar 106, and the door can be rotated around the one side open.

Moreover, on the rear surface of this pillar 106, a fluorescent lamp 108 for illuminating the display chamber is vertically installed. It is to be noted that in FIG. 10, to clearly show the attachment positions of the fluorescent lamps 108, the lamps are shown on the front sides of the doors 105, but the fluorescent lamps 108 are actually provided on the rear surfaces of the pillars 106 positioned in the display chamber 104. In consequence, commodities displayed on the shelves 107 in the display chamber 104 are illuminated by the fluorescent lamps 108.

Here, light emitted from the fluorescent lamps 108 provided on the rear surfaces of the pillars 106 is diffused from the outer surfaces of fluorescent tubes constituting the fluorescent lamps 108 to illuminate the display chamber 104. However, the light from the fluorescent lamps 108 is diffused toward the display chamber 104, and hence the centers of the front parts of the shelves 107 cannot be irradiated with a sufficient quantity of light. In FIGS. 10 and 11, a hatched portion is a portion to which a sufficient quantity of light is not supplied and which therefore becomes dark.

Thus, positions away from the fluorescent lamps 108, that is, the centers of the front parts of the shelves 107, a portion around a top plate of the display chamber 104 and a portion around a deck pan are darker than the other portions, and there is a problem that the commodities cannot sufficiently be illuminated. In particular, in the showcase 100 where the commodities are displayed toward the front surface of the showcase, the commodities in front portions on the shelves 107 need to be illuminated, but the commodities on foremost parts of the shelves 107 which can be seen through the see-through doors 105 cannot be illuminated. In consequence, the display and presentation effects of the whole showcase lower, and there also has occurred a disadvantage that the commodities around the centers of the shelves expected to promote purchasing most cannot be illuminated.

Moreover, since the pillars 106 are provided, any commodity is not displayed on the shelves 107 positioned behind the pillars 106. However, since the fluorescent lamps 108 are provided on the rear surfaces of the pillars 106, the light from the fluorescent lamps 108 is emitted even behind the pillars 106, and the light is uselessly diffused.

SUMMARY OF THE INVENTION

The present invention has been developed to solve a conventional technical problem, and an object thereof is to provide a showcase capable of effectively illuminating commodities displayed on a shelf in a display chamber, especially commodities on shelf foremost parts.

A showcase of the invention of a first aspect is characterized in that a shelf for displaying commodities is disposed in a display chamber constituted in a main body, a front-surface opening of the display chamber is openably closed by see-through doors, and an illumination device is vertically attached to the main body on an inner side from the edge of the opening, the illumination device being constituted of LED elements, light from the LED elements being emitted toward front parts of the shelf.

The showcase of the invention of a second aspect is characterized in that in the above invention, the illumination device is constituted of an LED illumination member including the plurality of LED elements, and a holding member holding the LED illumination member and attached to the main body, and the holding member is formed of a reflective plate portion positioned on the door side of the LED illumination member.

The showcase of the invention of a third aspect is characterized in that in the invention of the first aspect, the illumination device is constituted of an LED illumination member including a plurality of LED elements, and a holding member holding the LED illumination member and attached to the main body, and the vertical position of the LED illumination member is changeable with respect to the holding member.

The showcase of the invention of a fourth aspect is characterized in that in the invention of the first aspect, the illumination device is constituted of an LED illumination member including a plurality of LED elements, and a holding member holding the LED illumination member and attached to the main body, and the holding member is rotatable around a vertical axis.

The showcase of the invention of a fifth aspect is characterized in that in the inventions of the second to fourth aspects, the LED illumination member includes a substrate having the surface to which a plurality of LED elements are attached, and a passage for heat release is formed in the holding member so that the passage is positioned on the side of the back surface of the substrate.

In the showcase of the invention of the first aspect, the shelf for displaying the commodities is disposed in the display chamber constituted in the main body, the front-surface opening of the display chamber is openably closed by the see-through doors, and the illumination device is vertically attached to the main body on the inner side from the edge of the opening. The illumination device is constituted of the LED elements, and the light from the LED elements is emitted toward the front parts of the shelf. Therefore, the light having high directivity can be emitted from the LED elements to the shelf front parts. In consequence, the commodities on the shelf, especially on the foremost parts of the shelf can evenly satisfactorily be illuminated, and an illumination effect can be improved.

According to the invention of the second aspect, in addition to the above invention, the illumination device is constituted of the LED illumination member including the plurality of LED elements, and the holding member holding the LED illumination member and attached to the main body, and the holding member is formed of the reflective plate portion positioned on the door side of the LED illumination member. Therefore, the light from the LED elements is not directly emitted to a customer before the front surface of the showcase, and a disadvantage that the customer is dazzled by the light can be avoided.

Moreover, the irradiation light from the LED elements can be reflected by the reflective plate portion positioned on the door side of the LED illumination member to illuminate the inside of the display chamber, so that the inside of the display chamber can more effectively be illuminated.

According to the invention of the third aspect, in addition to the invention of the first aspect, the illumination device is constituted of the LED illumination member including the plurality of LED elements, and the holding member holding the LED illumination member and attached to the main body, and the vertical position of the LED illumination member is changeable with respect to the holding member. Therefore, with the movement of the shelf in the display chamber, the vertical attachment position of the LED illumination member held by the holding member can be changed to efficiently illuminate the commodities on the shelf.

According to the invention of the fourth aspect, in the invention of the first aspect, the illumination device is constituted of the LED illumination member including the plurality of LED elements, and the holding member holding the LED illumination member and attached to the main body, and the holding member is rotatable around the vertical axis. Therefore, the illuminating direction of the LED illumination member can be adjusted in accordance with a use situation.

In consequence, an illumination pattern can arbitrarily be changed, and illumination can variously be realized.

According to the invention of the fifth aspect, in the inventions of the second to fourth aspects, the LED illumination member includes the substrate having the surface to which the plurality of LED elements are attached, and the passage for heat release is formed in the holding member so that the passage is positioned on the side of the back surface of the substrate. Therefore, waste heat from the substrate generated by energizing the LED elements can smoothly be released along the passage for heat release. In consequence, the deterioration or failure of the LED illumination member can be prevented or suppressed.

DETAILED DESCRIPTION OF THE PREFERRED EMBODIMENT

Figure 1:
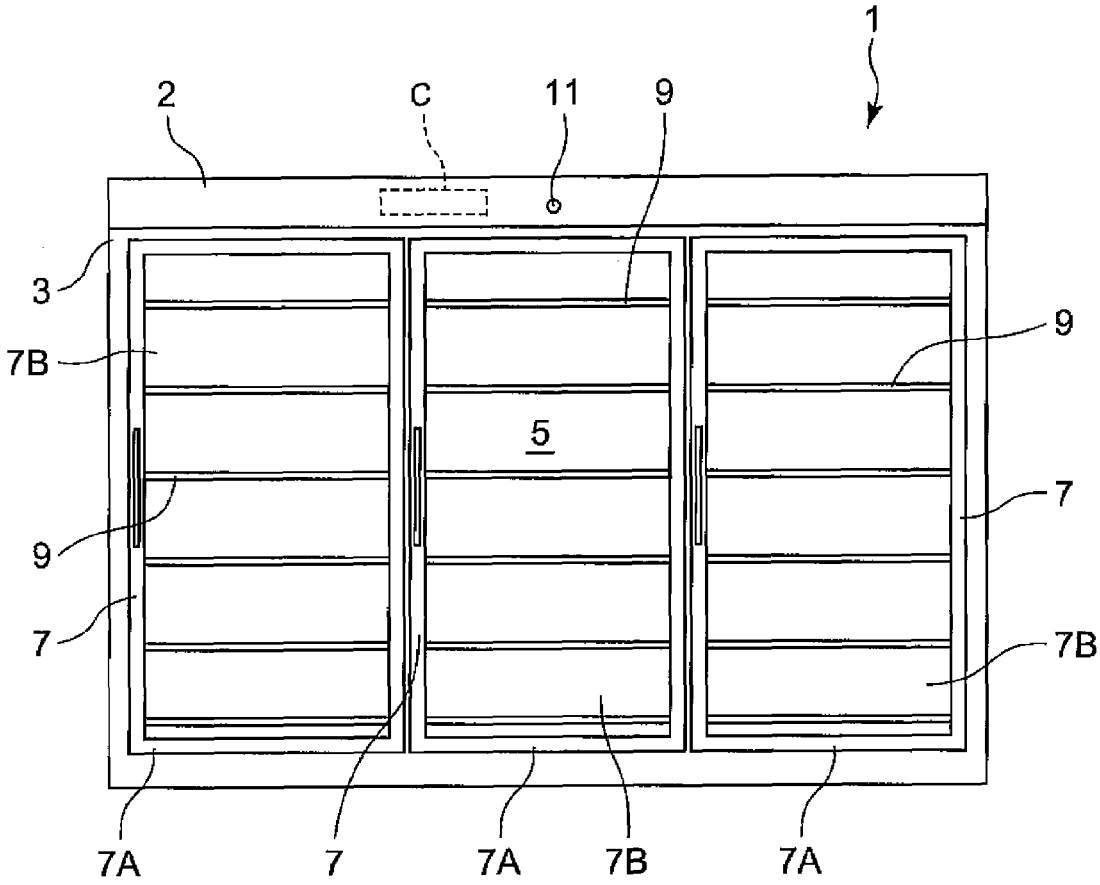
FIG. 1 is a front view of a showcase to which the present invention is applied.
Figure 2:
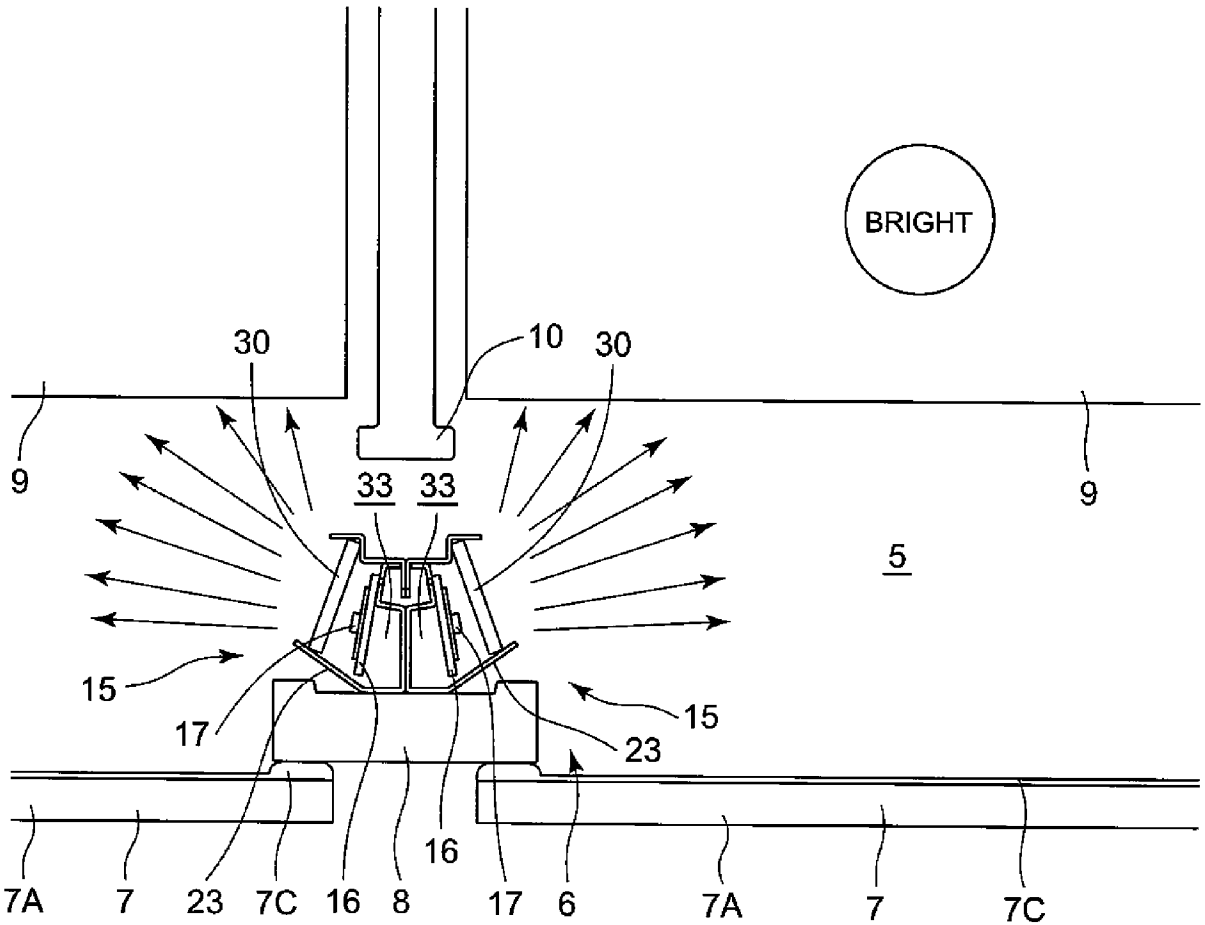
FIG. 2 is a partially enlarged sectional view of the showcase of FIG. 1.

An embodiment of the present invention will hereinafter be described with reference to the drawings. FIG. 1 shows a front view of a showcase 1 to which the present invention is applied, and FIG. 2 shows a partially enlarged sectional view of the showcase 1. The showcase 1 is a low-temperature showcase installed in a supermarket, a convenience store or the like, and a main body is constituted of an insulating box body (an insulating wall) 2 having an open front surface.

This insulating box body 2 is constituted of an outer box 3 having an open front surface and formed of a steel plate; an inner box (not shown) assembled in this outer box 3 with a space being left between the inner box and the outer box, having an open front surface, and formed of a steel plate or a hard resin; and a foam insulating material with which a space between the outer box 3 and the inner box is filled and which is made of foam polyurethane.

A display chamber 5 is constituted in this inner box, and a front-surface opening 6 of the display chamber 5 across the upper and lower ends of the opening is openably closed by a plurality of (three in the present embodiment) rotary glass doors 7, 7 and 7 through which the inside can be seen. Each of the glass doors 7 is constituted of a frame member 7A constituting a door edge, and a glass plate 7B which is provided in the frame member 7A and through which the inside can be seen, and the rear surface of the frame member 7A is provided with a gasket 7C.

In the edge of the front-surface opening 6 of the insulating box body 2, a plurality of (in this case, the three doors 7 are provided, and hence two) pillars 8 are vertically provided with a predetermined space being left between the pillars. The pillars 8 are, for example, pole-like members constituted of an insulating material. Therefore, in each glass door 7, the rear-surface gasket 7C comes in close contact with the edge of the front-surface opening 6 and the front surface of each pillar 8 to close the display chamber 5.

Moreover, shelf pillars 10 are vertically provided in the back surface and front part of the display chamber 5, and a plurality of stages of shelves 9 are disposed on the shelf pillars 10. It is to be noted that the shelf pillars 10 are provided with a plurality of engagement holes formed with a predetermined space being left between the holes. When the engagement holes for disposing the shelves 9 are changed, the height positions of the shelves 9 can be changed.

It is to be noted that in the present embodiment, in the rear surface and front part of the display chamber 5, the shelf pillars 10 are provided behind the pillars 8. Therefore, the plurality of stages of shelves 9 are disposed behind the glass doors 7.

Moreover, in the upper part of the display chamber 5, a cooler and a blower constituting a cooling device (not shown) are installed. The cooler constitutes the cooling device which is separately installed and in which a so-called refrigerating cycle is constituted together with a compressor (not shown), a condenser (not shown) and the like. When cold air from this cooler is forcibly circulated through the display chamber 5 by the blower, the inside of the display chamber 5 is cooled to a predetermined temperature.

Figure 3:
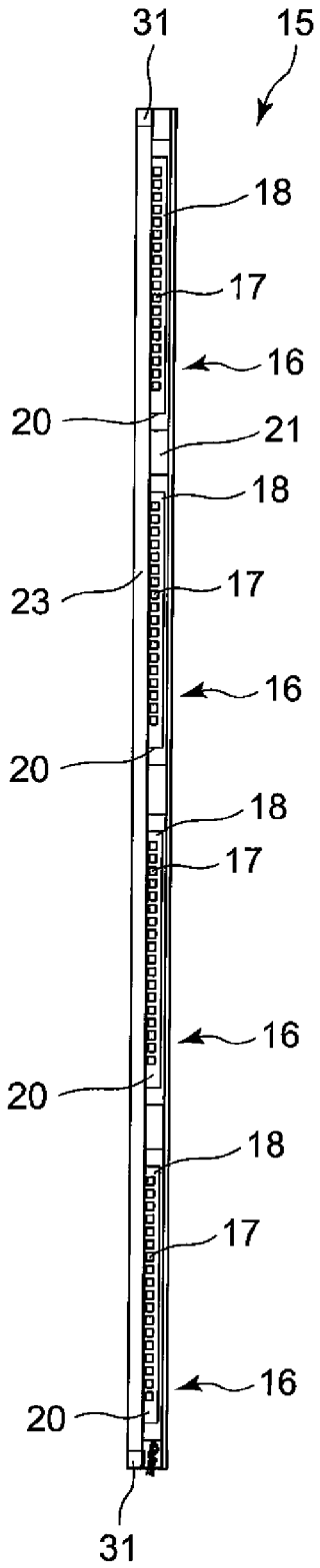
FIG. 3 is a side view of an illumination device.
Figure 4:
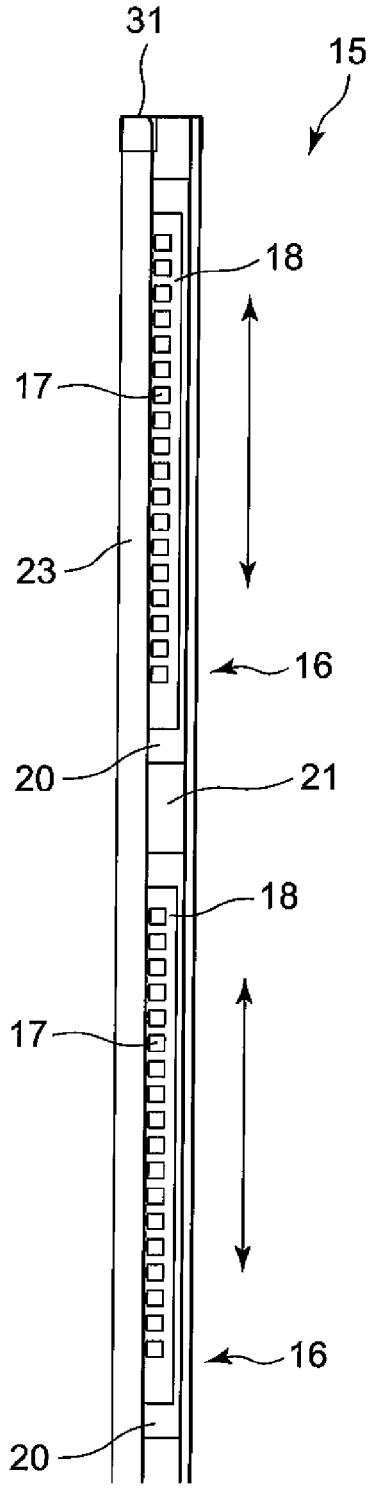
FIG. 4 is a partially enlarged diagram of FIG. 3.
Figure 5:
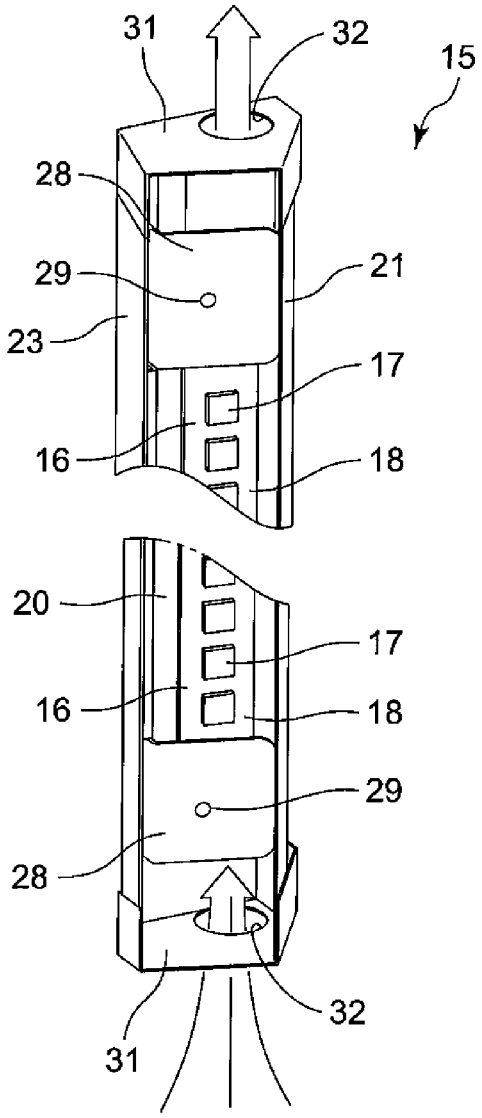
FIG. 5 is a partially omitted perspective view of the illumination device showing the flow of cold air.
Figure 6:
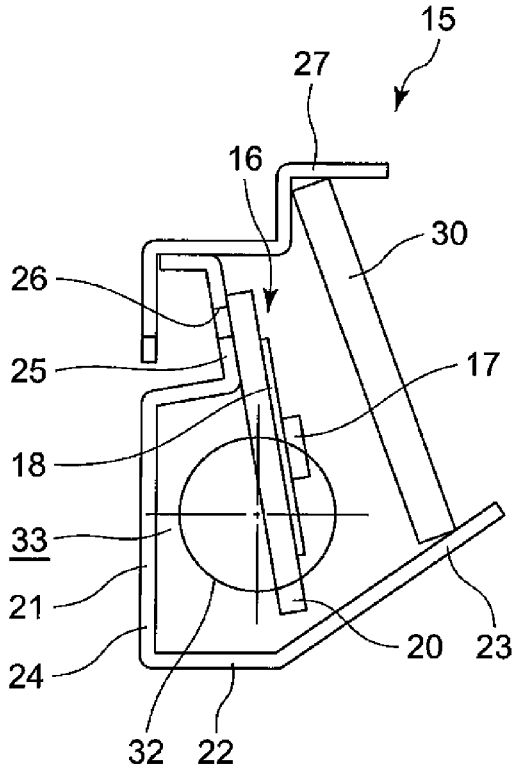
FIG. 6 is a transverse sectional view of the illumination device.
Figure 7:
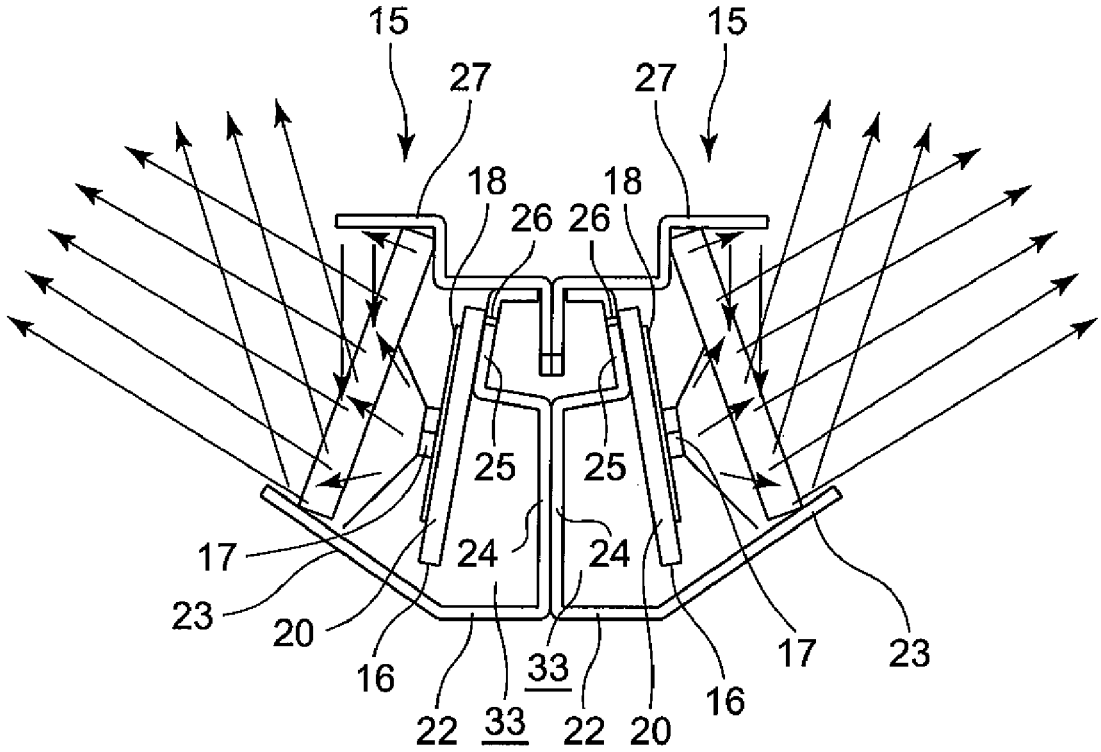
FIG. 7 is a transverse sectional view (pillars are omitted) of the illumination device provided on the pillars.

Next, an illumination device 15 provided in the display chamber 5 will be described in detail with reference to FIGS. 2 and 3 to 7. FIG. 3 shows a side view of the illumination device 15, FIG. 4 shows a partially enlarged diagram of FIG. 3, FIG. 5 shows a partially omitted perspective view of the illumination device 15 showing the flow of the cold air, FIG. 6 shows a transverse sectional view of the illumination device 15, and FIG. 7 shows a transverse sectional view (the pillars 8 are omitted) of the illumination devices 15, 15 provided on the pillars 8.

In the present embodiment, the illumination devices 15 are vertically provided on the inner side from the edge of the opening 6 of the insulating box body 2 constituting the main body, specifically on the front corners of the display chamber 5 and the rear surfaces of the pillars 8. Each of the illumination devices 15 is constituted of a plurality of LED illumination members 16, holding members 21 holding the LED illumination members 16 and attached on the inner side from the edge of the opening 6 of the insulating box body 2, shades 30 and cover members 31.

Each of the LED illumination members 16 is constituted of a substrate 18 provided with a plurality of LED elements 17, and the substrate 18 is fixed to a thermally conductive attachment plate 20. It is to be noted that this attachment plate 20 is provided with screw holes for fixing the holding member 21 with screws. The substrate 18 is constituted so as to extend in a longitudinal direction, and the substrate 18 is provided with the plurality of LED elements 17 with a predetermined space being left between the elements. The LED elements 17 in the present embodiment are chip-type white LED elements.

The holding member 21 is a member constituted so as to vertically extend with respect to the front-surface opening 6 of the insulating box body 2. The holding member 21 has a substantially U-shaped section, and the upper and lower ends of the member are closed with the cover members 31. It is to be noted that the cover members 31 are provided with communication holes 32 so that the cold air can be circulated through the cover members as described later in detail.

The front wall of this holding member 21 is provided with an attachment surface 22 which comes in close contact with the rear surface of the pillar 8 or the rear surface of a front wall constituting the front corners of the insulating box body 2, and a reflective plate portion 23 formed by bending the end of the attachment surface 22 as much as a predetermined angle rearwards.

Moreover, a side wall 24 which faces the substantially U-shaped opening is formed by bending the end of the attachment surface 22 as much as a substantially right angle rearwards, and the rear end of the side wall 24 is provided with an illumination member attachment portion 25 which protrudes internally from the holding member, that is, toward the opening side. This illumination member attachment portion 25 is constituted so as to vertically extend with respect to the front-surface opening 6 of the insulating box body 2, and is provided with a plurality of vertically long extending elongated holes 26 . . . . The elongated holes 26 are holes to be superimposed on the screw holes of the attachment plate 20 of the LED illumination member 16 so that the holding member is fixed with the screws, and the vertical attachment position of the LED illumination member 16 can be changed as much as the length dimension of the elongated holes 26. Moreover, a substantially U-shaped rear wall is provided with an engagement portion 27 to be engaged with the shade 30.

The shade 30 is constituted of a light transmitting colorless transparent material for covering the holding member 21 from the outside, and the shade is detachably attached with decorative screws or the like to be superimposed on shade attachment pieces 28 formed on the upper and lower portions of the holding member 21. In FIG. 5, reference numerals 29 are screw holes for fixing the shade 30 with the decorative screws.

A procedure for attaching the illumination devices 15 having such a constitution will be described. First, the holding member 21 is attached on the inner side from the edge of the opening 6 of the insulating box body 2. In the present embodiment, since the illumination devices 15 are positioned on both sides of each glass door 7, the holding members are attached to both front corners of the display chamber 5 and the rear surfaces of the pillars 8. It is to be noted that since the pillar 8 is positioned between the glass doors 7 and 7, two holding members 21 are attached so that the side walls 24 of the members abut on each other (a state shown in FIGS. 2 and 7). Moreover, the illumination devices 15 provided in the front corners are attached so that the irradiation light from the LED elements 17 is emitted toward the inside of the display chamber 5.

Then, the attachment plates 20 provided with the LED elements 17 are attached to the illumination member attachment portions 25 of the holding members 21, and the screw holes of the attachment plates 20 are superimposed on the elongated holes 26 to fix the attachment plates 20 with the screws. At this time, as shown in FIG. 6, each illumination member attachment portion 25 is formed so as to slightly tilt rearwards with respect to the edge of the opening 6 of the insulating box body 2. It is to be noted that in the present embodiment, a plurality of (four) LED illumination members 16 described above are attached to each holding member 21. The illumination device 15 may be constituted of the single LED illumination member 16 constituted across the upper and lower ends of the front-surface opening 6, and the vertical position of the device may be changed in accordance with the elongated holes 26 for the attachment. However, when the device is constituted of a plurality of LED illumination members 16 as in the present embodiment, production cost can be decreased, and handle ability can be improved.

Moreover, the illumination member attachment portion 25 to which the attachment plate 20 is fixed protrudes inwardly from the side wall 24 (the opening side of the holding member 21), and hence a passage 33 for heat release is formed between the side wall 24 and the attachment plate 20, that is, the backside of the substrate 18 in the holding member 21. It is to be noted that the upper and lower ends of the passage 33 for heat release are connected to the communication holes 32 formed in the cover members 31.

Furthermore, the reflective plate portion. 23 of the holding member 21 is positioned on the glass door 7 side of the LED illumination member 16. In addition, on the opening side of the holding member 21, the shade 30 for covering the LED illumination member 16 from the outside is attached. It is to be noted that the shade 30 is detachably engaged with the engagement portion 27 formed on the opening side of the holding member 21 and the end of the reflective plate portion 23. In consequence, the shade 30 is attached so that the shade is directed to the inside of the display chamber 5 slightly from a position substantially parallel to the glass door 7.

It is to be noted that the compressor and the blower constituting the cooling device as described above, the illumination device 15 and the like are controlled by a control device C constituted of a versatile microcomputer. Moreover, this control device C is connected to a person detecting sensor 11 for detecting any person who comes close to the showcase 1. It is to be noted that the person detecting sensor 11 is provided on, for example, the front surface of the center of the upper part of the insulating box body 2.

Therefore, when the person detecting sensor 11 detects that the person comes close to the showcase 1, the control device C energizes the illumination devices 15 to illuminate the display chamber 5 from the front side. It is to be noted that the control device C stops the energization of the illumination devices 15 after elapse of a predetermined time from a time when the person detecting sensor 11 does not detect any person coming close to the showcase.

According to such a constitution, the light from the LED elements 17 of each illumination member 16 fixed to the illumination member attachment portion 25 of the holding member 21 is emitted in a lateral direction (substantially parallel to the glass door 7) from behind both the side portions of the glass door 7. It is to be noted that in the present embodiment, as described above, the LED illumination member is slightly tilted rearwards (on the display chamber 5 side) with respect to the edge of the opening 6 of the insulating box body 2. In consequence, since the light from the illumination device 15 is emitted toward the front parts of the shelves 9 disposed in the display chamber 5, the light from the LED elements 17, having high directivity, can be emitted toward the front parts of the shelves 9. In consequence, the commodities on the shelves 9, especially in a foremost part can evenly satisfactorily be illuminated, and the front surfaces of the commodities can effectively be illuminated. Therefore, commodity illumination and display effects can be improved.

Moreover, the illumination device 15 illuminates a portion behind the pillar 8 or the like where any commodity is not displayed as little as possible, and the light can efficiently be emitted onto the shelves 9 where the commodities are displayed, so that the wasting of the irradiation light can be suppressed.

Furthermore, the LED elements 17 have a remarkably long life as compared with a fluorescent lamp, which can obviate a need for an illumination replacing operation. In consequence, it is possible to obviate a need for a laborious operation such as the storage of replacing components or the disposal of wastes discharged owing to the replacement.

It is to be noted that in the present embodiment, the LED illumination member 16 is tilted slightly rearwards when attached, but this is not restrictive, and the member may be attached in parallel with the glass door 7 (in a lateral direction).

Moreover, since the holding member 21 holding each LED illumination member 16 is provided with the reflective plate portion 23 positioned on the glass door 7 side of the LED illumination member 16, the light from the LED elements 17 is not directly emitted to any customer before the front surface of the showcase 1, and a disadvantage that the customer is dazzled by the light can be avoided.

Furthermore, the irradiation light from the LED elements 17 can be reflected by the reflective plate portion 23 positioned on the glass door 7 side of the LED illumination member 16 and bent as much as the predetermined angle rearwards to illuminate the inside of the display chamber 5, so that the inside of the display chamber 5 can more effectively be illuminated.

Additionally, in the present embodiment, the illumination member attachment portion 25 of the holding member 21 holding each LED illumination member 16 is provided with the elongated holes 26 extending in the vertical direction. Therefore, when the attachment position of the LED illumination member 16 (the attachment plate 20) with respect to the elongated holes 26 is changed, as shown by arrows in FIG. 4, the vertical position of the LED illumination member 16 can be changed to attach the LED illumination member to the holding member 21.

In consequence, when the vertical attachment position of the LED illumination member 16 held by the holding member 21 is changed in accordance with the movement of the shelves 9 or the display situation of the commodities in the display chamber 5, the commodities on the shelves 9 can efficiently be illuminated.

Moreover, the holding member 21 to which the LED illumination member 16 is attached is provided with the passage 33 for heat release positioned on the side of the back surface of the substrate 18. In consequence, waste heat from the substrate 18 generated by the energization of the LED elements 17 can smoothly be released along the passage 33 for heat release. Therefore, the deterioration or failure of the LED illumination member 16 can be prevented or suppressed. It is to be noted that cold air to be circulated in the display chamber 5 can be circulated through the passage 33 for heat release via the communication holes 32 of the cover members 31 provided on the upper and lower ends of the holding member 21 (see FIG. 5), so that the waste heat from the substrate 18 of the LED illumination member 16 can smoothly be released.

Figure 8:
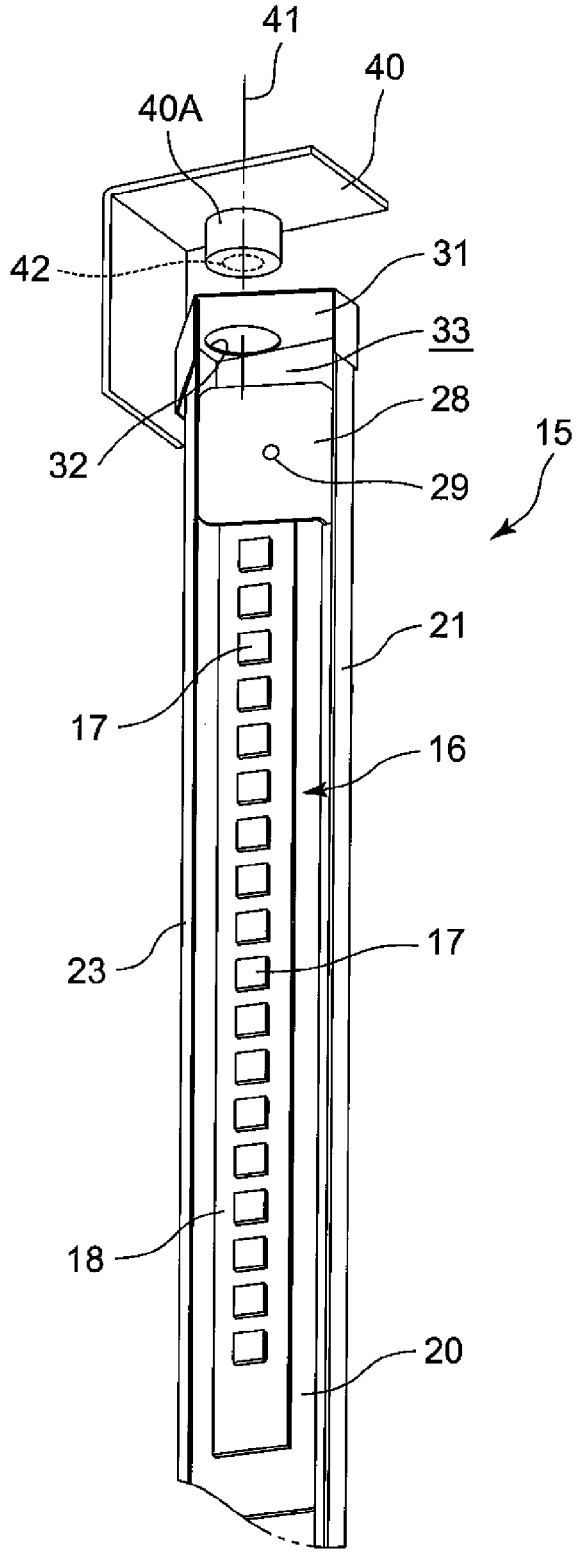
FIG. 8 is a partially enlarged diagram of an illumination device as another embodiment.

Furthermore, in the present embodiment, the holding members 21 constituting the illumination devices 15 are fixed to the inner side from the edge of the front-surface opening 6 of the main body, for example, the rear surfaces of the pillars 8 and the front corners of the edge of the opening 6 of the insulating box body 2, but this is not restrictive. As shown in FIG. 8, rotary members 40 may be attached to the side surfaces of the pillars 8 or the side surfaces of the inner box (the main body) positioned in the edge of the opening 6 of the insulating box body 2, and each holding member 21 provided with the LED illumination member 16 may be rotated around a vertical axis 41.

Specifically, the rotary members 40 have vertical shaft portions 40A protruding on the display chamber 5 side, and the shaft portions 40A are inserted into and rotatably attached to the communication holes 32 of the cover members 31 attached to the holding member 21. It is to be noted that each of the shaft portions 40A is provided with a communication hole 42 extending through the shaft portion in the vertical direction.

Figure 9:
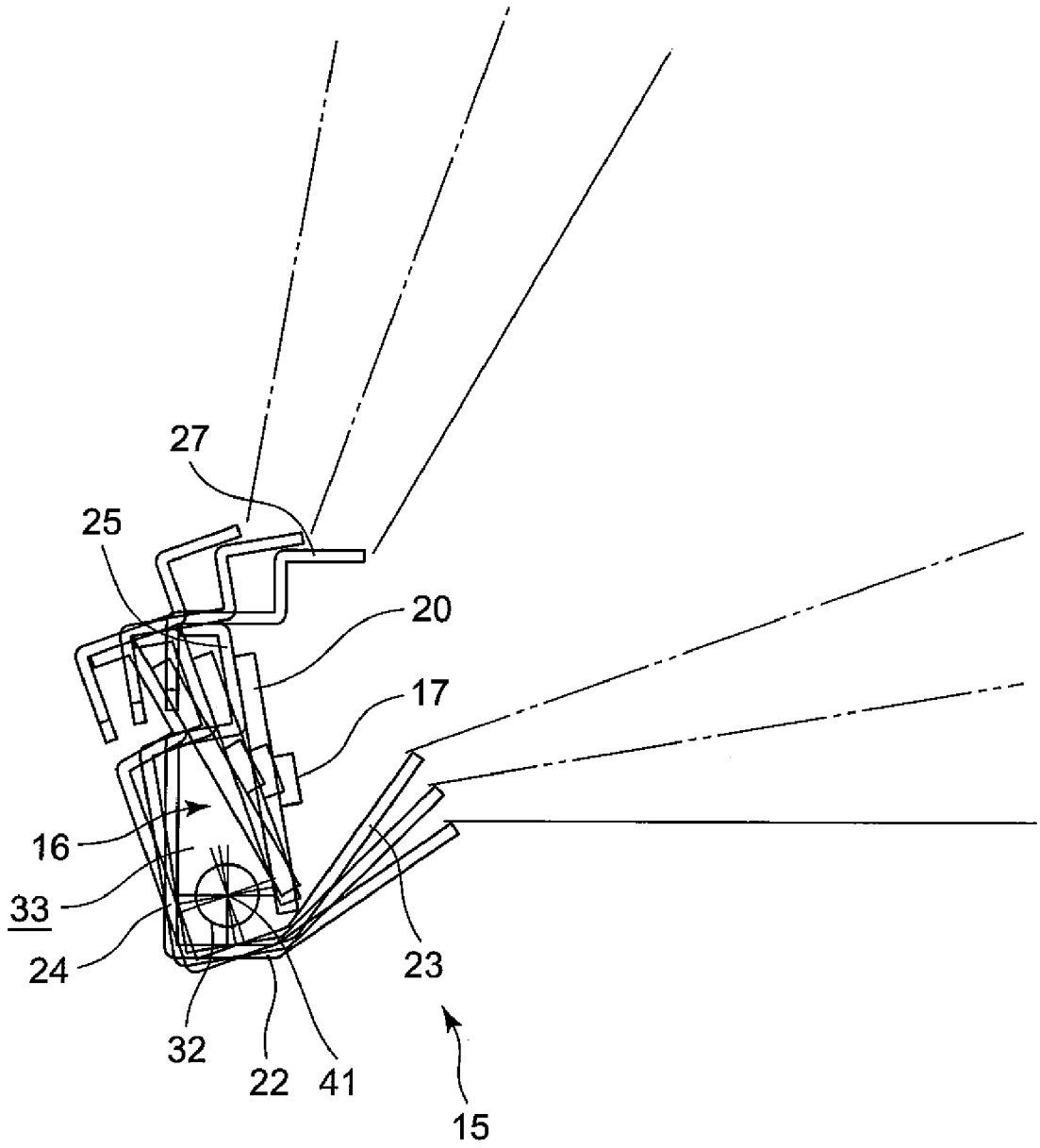
FIG. 9 is a transverse sectional view showing the rotary state of the illumination device of FIG. 8.
Figure 10:
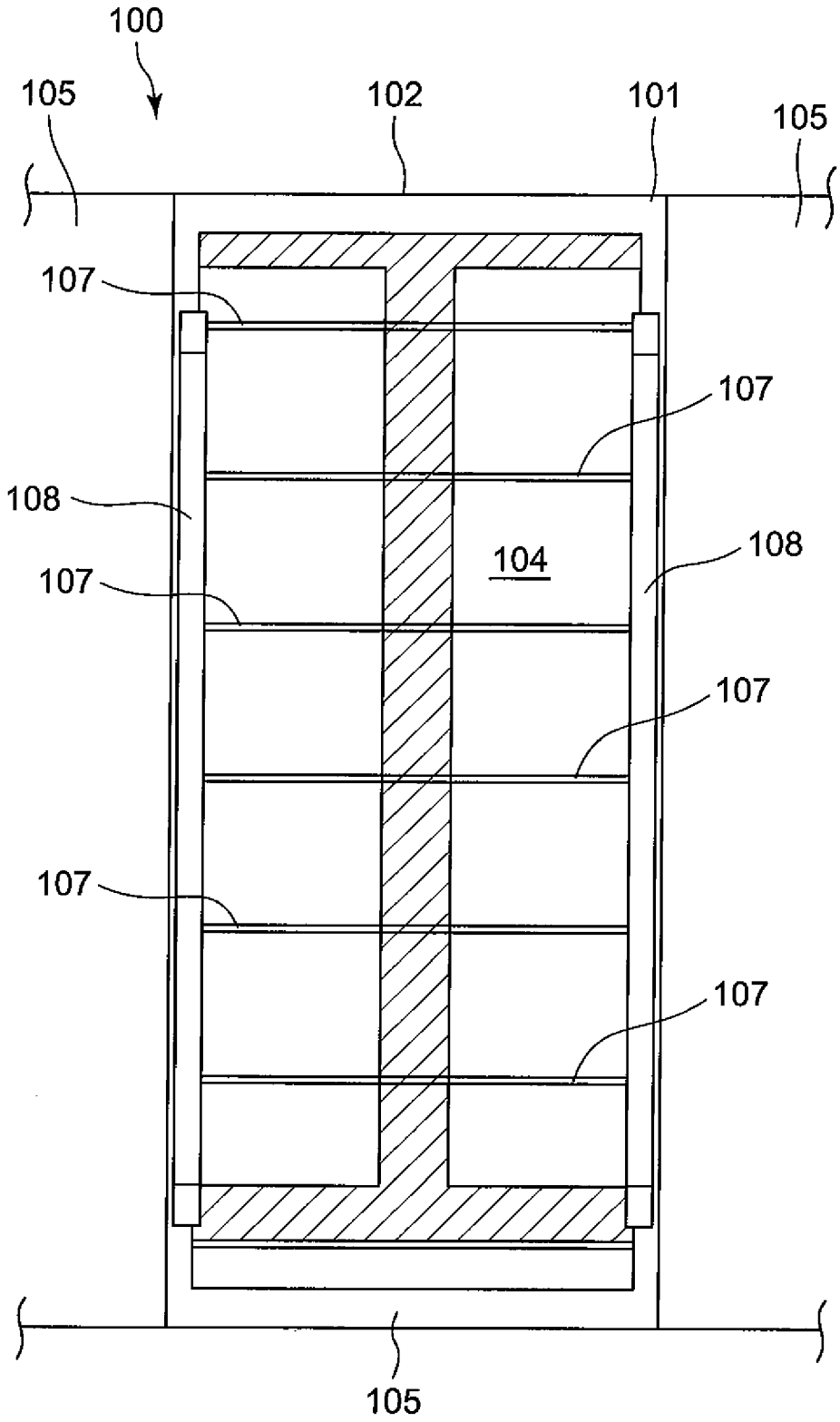
FIG. 10 is a front view showing the illumination state of a part of a conventional reach-in showcase.
Figure 11:
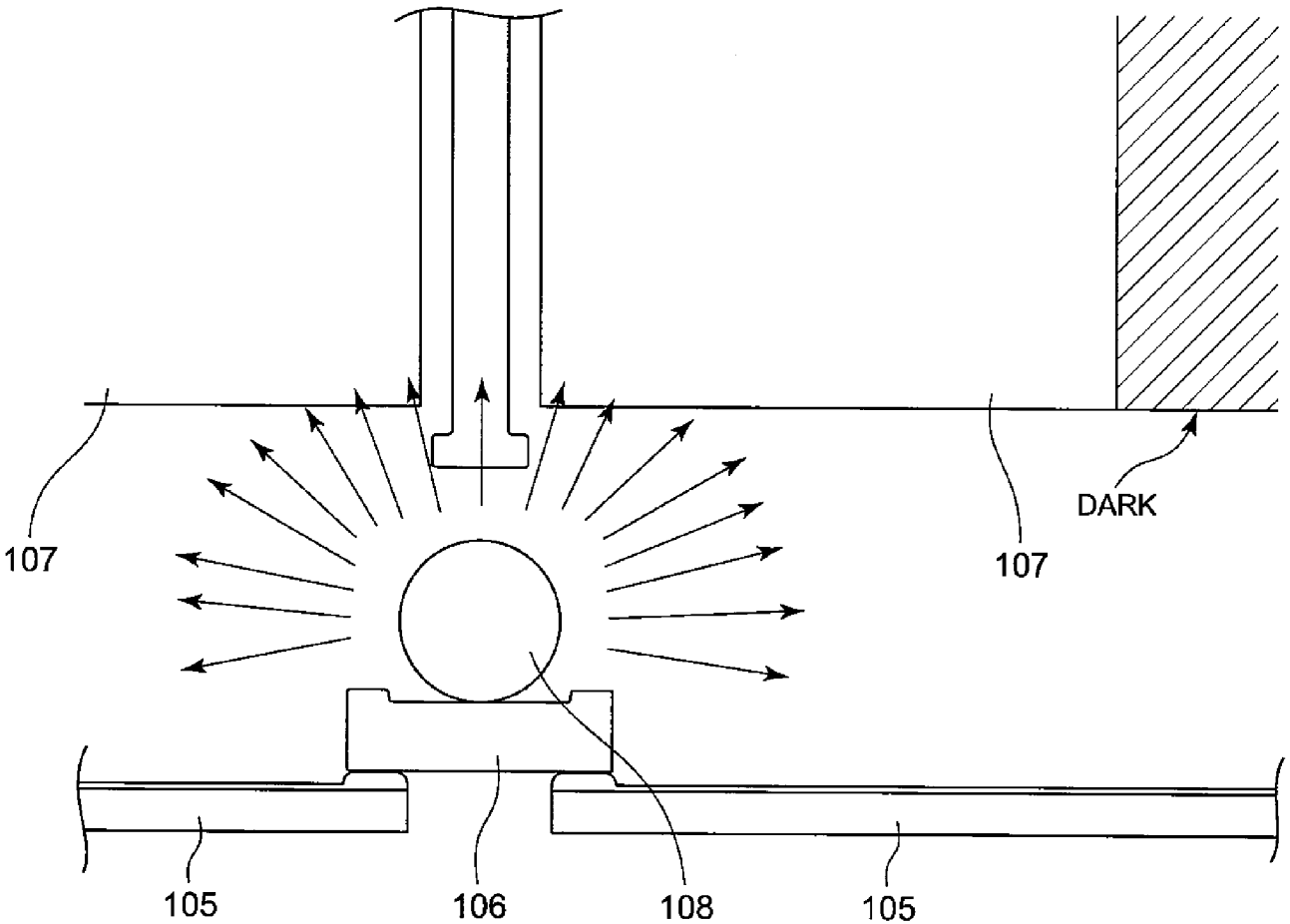
FIG. 11 is a partially enlarged sectional view showing the illumination state of FIG. 10.

In consequence, when the holding member 21 is rotated around the axis 41 in accordance with the use situation, the irradiating direction of the light by the LED illumination member 16 can be adjusted (see FIG. 9). Therefore, when the holding member 21 is further rotated rearwards, even the rear part of the display chamber 5 can be illuminated with the irradiation light from the LED elements 17. Moreover, when the holding member 21 is further rotated forwards, the front part of the display chamber 5 (mainly the foremost parts of the shelves 9) can evenly be illuminated with the irradiation light from the LED elements 17. Consequently, an illumination pattern can arbitrarily and easily be changed, and the illumination can variously be realized.

What is claimed is:

1. A showcase in which a shelf for displaying commodities is disposed in a display chamber constituted in a main body and in which a front-surface opening of the display chamber is openably closed by see-through doors and in which an illumination device is vertically attached to a pillar of the main body on an inner side from an edge of the opening, light from the illumination device being emitted toward front parts of the shelf, wherein the pillar is disposed in the display chamber between the doors and the shelf, wherein the illumination device includes an LED illumination member having LED elements and includes a holding member, wherein the holding member includes an attachment surface and a reflective plate portion formed by bending an end of the attachment surface, wherein the attachment surface is in close contact with the main body, wherein the holding member holds the LED illumination member and is attached to the main body, and the reflective plate portion is positioned on the door side of the LED illumination member.

2. A showcase in which a shelf for displaying commodities is disposed in a display chamber constituted in a main body and in which a front-surface opening of the display chamber is openably closed by see-through doors and in which an illumination device is vertically attached to a pillar of the main body on an inner side from an edge of the opening, light from the illumination device being emitted toward front parts of the shelf, wherein the pillar is disposed in the display chamber between the doors and the shelf, wherein the illumination device includes an LED illumination member having LED elements and includes a holding member, wherein the holding member includes an attachment surface and a reflective plate portion formed by bending an end of the attachment surface, wherein the attachment surface is in close contact with the main body, wherein the LED illumination member includes a substrate having the surface to which the LED elements are attached, and a passage for heat release is formed in the holding member so that the passage is positioned on the side of the back surface of the substrate.

* * * * *